US005844502A

United States Patent [19]

Perez et al.

[11] Patent Number: 5,844,502

[45] Date of Patent: Dec. 1, 1998

[54] TEMPERATURE-COMPENSATED OBJECT SENSING DEVICE AND METHOD THEREFOR

[75] Inventors: Daniel Perez, Foothill Ranch; Walter Parsadayan, Lake Forest, both of Calif.

[73] Assignee: Elite Access Systems, Inc., Lake Forest, Calif.

[21] Appl. No.: 898,619

[22] Filed: Jul. 22, 1997

[51] Int. Cl.[6] ..... G08G 1/01

[52] U.S. Cl. ..... 340/941; 340/933; 340/910; 340/917; 340/918; 324/236; 324/654

[58] Field of Search ..... 340/941, 933, 340/932.2, 934, 935, 910, 939, 916, 917, 918; 324/236, 238, 244, 654, 655

[56] References Cited

U.S. PATENT DOCUMENTS

| | | | |
|---|---|---|---|
| 3,651,452 | 3/1972 | Friedman | 340/941 |
| 3,818,430 | 6/1974 | Williams | 340/38 L |
| 3,868,626 | 2/1975 | Masher | 340/38 L |
| 3,870,990 | 3/1975 | Fathauer | 340/941 |
| 3,875,555 | 4/1975 | Potter | 340/38 L |
| 3,984,764 | 10/1976 | Koerner | 324/41 |
| 4,038,633 | 7/1977 | King | 340/38 L |
| 4,075,563 | 2/1978 | Battle | 324/236 |
| 4,430,636 | 2/1984 | Bruce | 340/941 |
| 4,459,561 | 7/1984 | Clark et al. | 340/941 |
| 4,472,706 | 9/1984 | Hodge et al. | 340/941 |
| 4,680,717 | 7/1987 | Martin | 364/436 |

*Primary Examiner*—Nina Tong
*Attorney, Agent, or Firm*—Oppenheimer Wolff & Donnelly LLP

[57] ABSTRACT

A device and method is provided for sensing an object or vehicle in proximity to a sensing zone, wherein the device is exposed to an environment temperature. The object sensing device comprises a sensor, such as an inductive loop having a characteristic, such as the inductance of the inductive loop, responsive to the proximity of the object is to the sensor; a signal generator, such as an oscillator, coupled to the sensor for producing a first periodical signal cycling at a first frequency dependent on the sensor characteristic and the environment temperature. A de-coupling mechanism for de-coupling or isolating the sensor from the signal generator so that the signal generator produces a second periodical signal cycling at a second frequency dependent on the environment temperature, but not substantially dependent on the characteristic of the sensor; and a device for producing a temperature-compensated response indicative of whether the object is in the sensing zone from the first and second periodical signals or their respective frequencies. Using the temperature-compensated object or vehicle sensing device, a gate operating system and a vehicle driver stimulus device is also provided herein.

34 Claims, 2 Drawing Sheets

FIG. 3
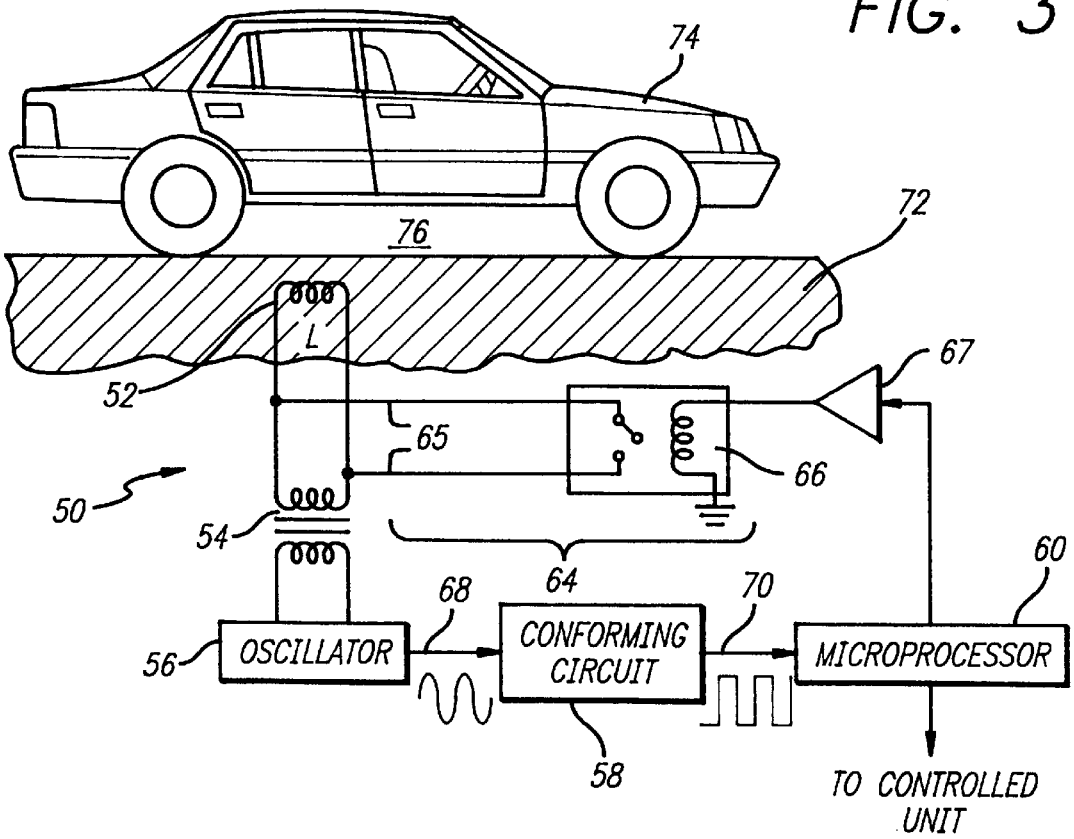
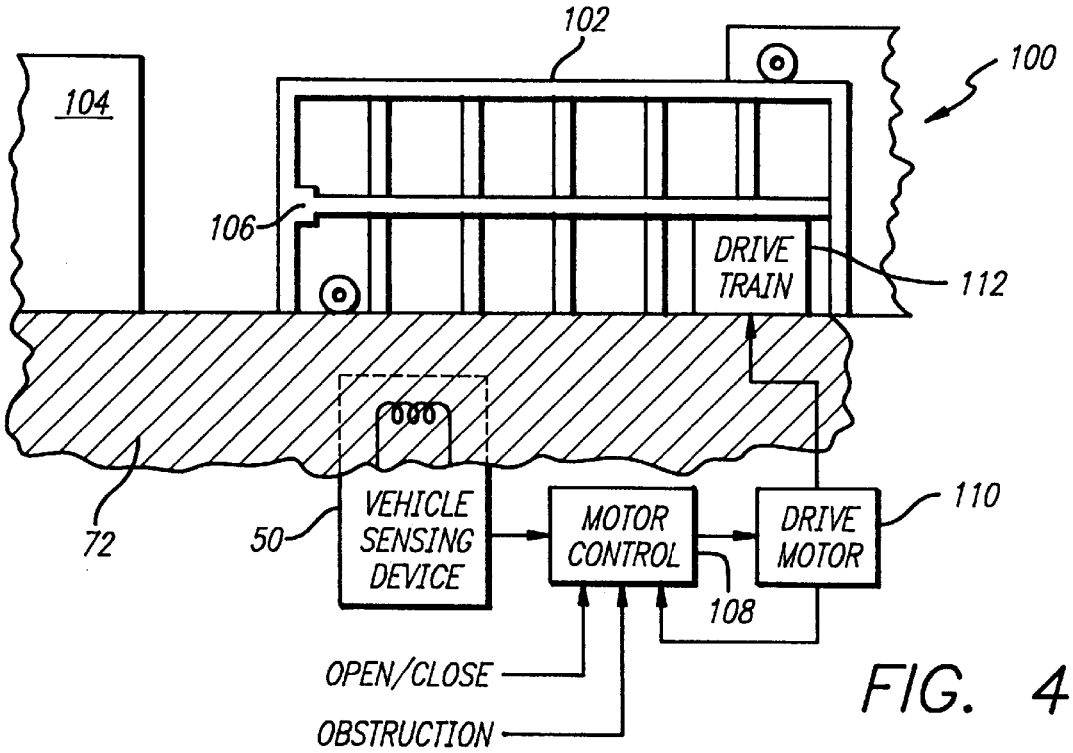
FIG. 4

TEMPERATURE-COMPENSATED OBJECT SENSING DEVICE AND METHOD THEREFOR

FIELD OF INVENTION

This invention generally relates to an apparatus and method for sensing the presence of objects in the vicinity of a sensing zone, and in particular, to an apparatus and method for sensing the presence of an object or vehicle in the vicinity of a sensing zone, wherein a unique technique for temperature compensation is provided to reduce the effects caused by environmental temperature changes.

BACKGROUND OF THE INVENTION

Vehicle sensing devices are employed in many applications. For instance, they are used in automatic gate openers for sensing the presence of a vehicle in a designated sensing zone near a gate so that the gate opens upon detection of such vehicle in that sensing zone. Another application for such vehicle sensing device includes, for example, traffic light controlling, where the timing of the traffic light is affected by the sensing of a vehicle in proximity of a designated sensing zone. Yet another application for the vehicle sensing device is for use in "stop-and-go" devices employed on highway on-ramps for controlling the rate in which vehicles can enter the highway, where the need for sensing the presence of a vehicle in a designated sensing zone is required. The above applications serve only as a few examples of applications for vehicle sensing devices, and many other applications that require the sensing of objects or vehicles are within the scope of the invention.

Referring initially to FIG. 1, a typical prior art vehicle sensing device 10 includes a sensor, such as an inductive loop 12, located near a sensing zone 22 and sometimes embedded in a pavement 20 that forms a portion of the road surface. The sensing zones described herein in this application will be the area surrounding the sensor or inductive loop that the presence of an object or vehicle therein causes a sufficient change in the sensor characteristic that the sensing device detects or determines the presence of the object or vehicle. The sensor or inductive loop 12 is generally coupled to a transducer, such as an oscillator 14, which produces a signal 16 that cycles at a frequency $f(L)$ that depends on the inductance L of the inductive loop 12. Typically, the inductive loop 12 is coupled to the oscillator tank circuit that determines the frequency $f$ of the signal 16. A discriminator or microprocessor 18 is coupled to the oscillator 14 for receiving the signal 16, determining whether the vehicle is within the sensing zone upon examination of the frequency of the signal 16, and controlling a particular device ("the controlled unit") if the vehicle 24 is determined to be in the sensing zone. The controlled unit may be, for example, an automatic gate, a traffic light controller, a stop-n-go device, or any device that performs a desired function in response to the presence of a vehicle 24, or more generally an object, in proximity to the sensing zone 22. A signal conditioning circuit (not shown) may also be included to filter and condition the signal 16 before it is processed by the discriminator or microprocessor 18.

The sensing function of the vehicle sensing device 10 comes about because of the change in the inductance L of the inductive loop 12 when a metallic object is brought in the proximity of the inductive loop. Typically, the change is to lower the inductance L which translates into a frequency increase of the signal 16 produced by the oscillator 14. Thus, when there is no object or vehicle 24 present in the sensing zone 22, the signal 16 produced by the oscillator 14 will cycle at a frequency $f_0(L_0)$, where $L_0$ is the inductance of the inductive loop 12 unaffected by the proximity of a metallic object. When there is an object or vehicle 24 present in the sensing zone 22, the signal 16 produced by the oscillator will cycle at a frequency $f_1(L_1)$, where $L_1$ is the inductance of the inductive loop 12 in the presence of a metallic object or vehicle 24 in the sensing zone 22. Typically, the inductance $L_1$ (vehicle present in sensing zone) is less than inductance $L_0$ (vehicle absent from sensing zone), which results in frequency $f_1(L_1)$ being greater than frequency $f_0(L_0)$.

By having the discriminator or microprocessor 18 sense the signal 16 produced by the oscillator 14 and detect its frequency $f(L)$, then the discriminator or microprocessor can determine whether there is a presence or absence of a vehicle 24 in the sensing zone. Specifically, if the discriminator or microprocessor 18 detects a frequency $f_0(L_0)$, then the discriminator or microprocessor knows that there is an absence of a vehicle in the sensing zone 22; and accordingly, does not issue an instruction to the controlled unit. If, on the other hand, the microprocessor 18 detects a frequency $f_1(L_1)$, then it knows that there is a presence of a vehicle 24 in the sensing zone 22; and accordingly, issues an appropriate instruction to the controlled unit, such as an open the gate instruction, or a turn the light "green" instruction or an instruction to perform the desired function of the controlled unit.

One problem with the prior art vehicle sensing device 10 is its dependency on the environment temperature T. The reason for the temperature dependency is that the signal 16 produced by the oscillator 14 has a frequency that varies also as a function of the environment temperature T. That is, the frequency of signal 16 can be represented by $f(L, T)$ to illustrate that it varies as a function of the inductance L of the inductive loop 12 and also as a function of the environment temperature T. The problem arises in that during the operation of the vehicle sensing device 10, the microprocessor or discriminator is looking for values of $f_0(L_0)$ and $f_1(L_1)$ in determining whether there is an absence or presence of a vehicle 24 in the sensing zone 22, respectively. However, because of the temperature dependency of the oscillator 14, the frequency of the signal 16 may not be either $f_0(L_0)$ or $f_1(L_1)$; instead it is either $f_3(L_0,T)$ or $f_4(L_1,T)$, where T is the environment temperature and is subject to variation. Therefore, the discriminator or microprocessor 18 may not know for certain whether there is an absence or a presence of a vehicle 24 in the sensing zone 22 due to this temperature variation.

Referring now to FIG. 2, a prior art attempt for temperature compensating the vehicle sensing device 10 of FIG. 1 is shown. The vehicle sensing device 10' shown in FIG. 2 is identical to that disclosed in FIG. 1, except for the inclusion of an additional element. Therefore, reference numbers for identical elements in FIG. 1 will be represented in FIG. 2 with the same reference number with the addition of a prime.

The prior art temperature-compensated vehicle sensing device 10' further includes a reference oscillator 26 coupled to the microprocessor 18' to achieve its temperature compensating function. The signal 28 produced by the reference oscillator 26 has a frequency $f_R(T)$ that varies also as a function of the environment temperature T; but does not vary as a function of the inductance L of the inductive loop 12'. The temperature compensation is performed by the discriminator or microprocessor 18' taking the difference between the current frequency reading $f_c(L_c, T)$ of the signal 16' produced by oscillator 14' and the frequency $f_R(T)$ of the signal 28 produced by the reference oscillator 26. The resulting frequency difference $f_{TC}(L)=f_c(L_c, T)-f_R(T)$ (the subscripts "TC" stands for temperature-compensated) is independent of the environment temperature T, since any temperature effects on the reference frequency $f_R(T)$ will similarly affect the current frequency reading $f_c(L_c, T)$.

Taking the previous example, let $f_0(L_0,T)$ represent the frequency of signal 16' produced by oscillator 14' when there is an absence of a vehicle 24' in the sensing zone 22', and $f_1(L_1, T)$ represent the frequency of the signal 16' in the presence of a vehicle 24' in the sensing zone 22'. When there is an absence of a vehicle 24' in the sensing zone 22', the temperature-compensated frequency as determined by the discriminator or microprocessor 18' is given by:

$$f_{TC0}(L_0)=f_0(L_0, T)-f_R(T)$$

When there is a presence of a vehicle 24' in the sensing zone 22', the temperature compensated frequency as determined by the discriminator or microprocessor 18' is given by:

$$f_{TC1}(L_1)=f_1(L_1, T)-f_R(T)$$

Therefore, instead of the microprocessor 18' detecting for $f_0(L_0, T)$ and $f_1(L_1, T)$ as in the vehicle sensing device 10 of FIG. 1, which are both dependent on the environment temperature, the microprocessor detects $f_{TC0}(L_0)$ and $f_{TC1}(L_1)$ which are both independent of the environment temperature T.

One drawback of the prior art temperature-compensated vehicle sensing device 10' is that it is complicated due to the addition of the reference oscillator 26. This results in an increase in manufacturing time and cost due to the addition of the reference oscillator. It also results in a less reliable product since the inclusion of more components translates into a statistically less reliable product. There is also an increase in time and cost due to testing and repair of the additional reference oscillator. Therefore, there is a need for a vehicle sensing device that provides temperature compensation without the need to include a reference oscillator.

OBJECT OF THE INVENTION

It is an object of this invention to provide an object or vehicle sensing device and method therefor that detects the presence of an object or vehicle in the vicinity or proximity of a sensing zone.

It is another object of this invention to provide an object or vehicle sensing device and method therefor that compensates for environment temperature variations.

It is yet another object of this invention to provide an object or vehicle sensing device and method therefor that uses a unique technique of temperature compensation due to environmental effects.

It is still another object of this invention to provide an object or vehicle sensing device and method therefor that provides for environmental temperature compensation that is cost-economical and easily manufacturable.

It is still another object of this invention to provide an object or vehicle sensing device and method therefor that provides for environmental temperature compensation that is more reliable.

It is still another object of this invention to provide an object or vehicle sensing device and method therefor that provides for environmental temperature compensation that is easier to test, maintain and repair.

SUMMARY OF THE INVENTION

The above objects and other objects are accomplished herein by the various aspects of the invention, wherein, briefly, a device for sensing an object in proximity to a sensing zone is provided herein, wherein the device is exposed to an environment temperature. The object sensing device comprises a sensor, such as an inductive loop, having a characteristic, such as the inductance of the inductive loop, responsive to the proximity of the object is to the sensor; a signal generator, such as an oscillator, coupled to the sensor for producing a first periodical signal cycling at a first frequency dependent on the sensor characteristic and the environment temperature. A de-coupling mechanism for de-coupling or isolating the sensor from said signal generator so that said signal generator produces a second periodical signal cycling at a second frequency dependent on the environment temperature, but not substantially dependent on the characteristic of the sensor; and a device for producing a temperature-compensated response indicative of whether the object is in the sensing zone from the first and second periodical signals or frequencies.

A method is also provided herein for temperature-compensating the sensing of an object in a sensing zone in the presence of an environment temperature comprising the steps of producing a sensing response indicative of the distance the object is from the sensing zone; generating a first periodical signal cycling at a first frequency that is dependent on the environment temperature and the response; isolating the sensing response from the generating of the first periodical signal step so that a second periodic signal is generated that cycles at a second frequency dependent on the environment temperature, but not substantially dependent on the sensing response; and producing a temperature-compensated response indicative of whether the object is in the sensing zone from the first and second periodical signals or frequencies.

A device is also provided herein for indicating to a vehicle driver to perform a certain driving action, wherein the device is responsive to the presence of a vehicle in a sensing zone, and wherein the device is exposed to an environment temperature. The driver indicating device comprises a sensor having a characteristic responsive to the distance of the vehicle is from the sensor; a signal generator coupled to the sensor for producing a first periodical signal cycling at a temperature-uncompensated frequency dependent on the sensor characteristic and the environment temperature; a de-coupling mechanism for de-coupling the sensor from the signal generator so that the signal generator produces a second periodical signal cycling at a reference frequency dependent on said environment temperature, but not substantially dependent on the characteristic of the sensor; a device for producing a temperature-compensated response from the temperature-uncompensated frequency and the reference frequency, wherein the temperature-compensated response is indicative of whether the vehicle is in the sensing zone; and a driver stimulus device for indicating to the vehicle driver to perform an action when the vehicle has been detected in said sensing zone.

A gate operating system is also provided herein for controlling a gate in response to a vehicle being detected in a sensing zone. The gate operating system comprises a drive train for moving the gate between open and closed positions, and a drive motor coupled to the drive train for causing the drive train to move the gate between the open and closed positions. The gate operating system also provides a vehicle sensing device comprising a sensor having a characteristic responsive to the proximity of the vehicle is to the sensor; a signal generator coupled to the sensor for producing a first periodical signal cycling at a first frequency dependent on the sensor characteristic and the environment temperature; a de-coupling mechanism for decoupling the sensor from the signal generator so that the signal generator produces a second periodical signal cycling at a second frequency dependent on the environment temperature, but not substantially dependent on the characteristic of the sensor; and a device for producing a temperature-compensated response indicative of whether the vehicle is in the sensing zone from the first and second periodical signals. The gate operating system further includes a motor control circuit coupled to the drive motor and to the temperature-compensated response producing device for receiving therefrom the temperature-compensated response, and for controlling the drive motor to cause the drive train to move the gate to the open position when the temperature-compensated response indicates the presence of the vehicle in the sensing zone.

BRIEF DESCRIPTION OF THE DRAWINGS

The above-mentioned and other objects and features of this invention and the manner of attaining them will become apparent, and the invention itself will be best understood by reference to the following description of the preferred embodiments of the invention taken in conjunction with the accompanying drawings, wherein:

FIG. 3 is a block diagram of a vehicle sensing device of the invention sensing the presence of a vehicle in the proximity of a sensing zone; and FIG. 4 is a block diagram of a gate operating system per another aspect of the invention.

DETAILED DISCUSSION OF THE PREFERRED EMBODIMENTS

Figure 1:
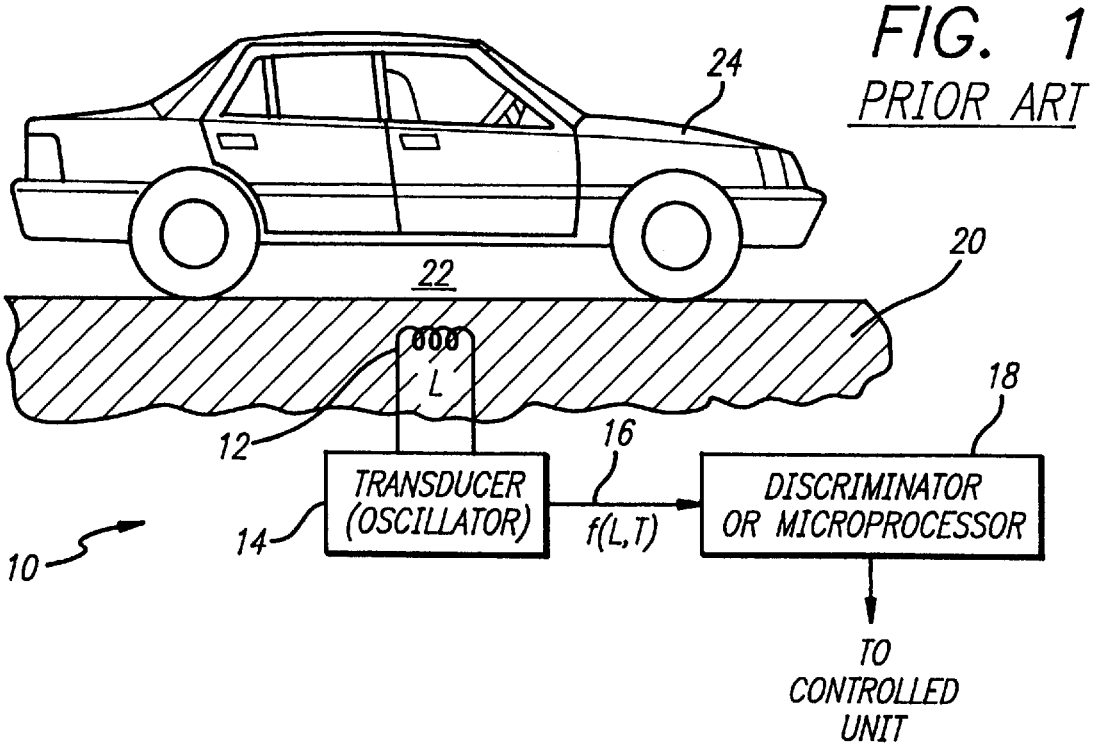
FIG. 1 PRIOR ART
FIG. 1 is a block diagram of a prior art vehicle sensing device having a loop detector embedded in a pavement for sensing the presence of a vehicle in a sensing zone.
Figure 2:
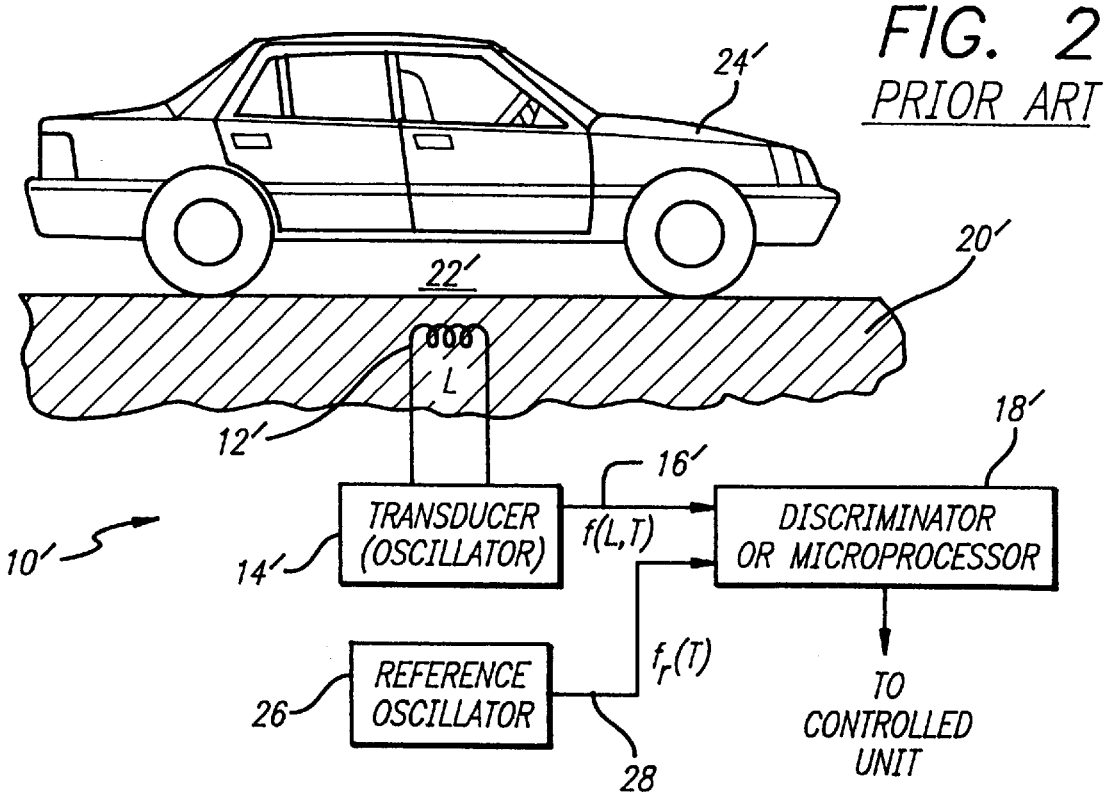
FIG. 2 PRIOR ART
FIG. 2 is a block diagram of another prior art vehicle sensing device having a loop detector embedded in a pavement for sensing the presence of a vehicle in a sensing zone.

Referring to FIG. 3, a block diagram of an object or vehicle sensing device 50 as per an embodiment of the invention is shown. The object or vehicle sensing device 50 is typically used for vehicle driver stimulus applications where the presence of a vehicle in a particular sensing zone triggers a driver stimulus device to indicate to the driver to perform a specific action. For instance, the object or vehicle sensing device 50 is useful for automatic gate openers where the presence of a vehicle in proximity to a sensing zone triggers the opening of the gate. The object or vehicle sensing device 50 is also useful in traffic light control units where the presence of a vehicle in proximity to a sensing zone, e.g. zones which are near the traffic light intersection, triggers the changing or timing of the traffic light. Another application for the object or vehicle sensing device 50 is for use in "stop-n-go" systems used typically on highway on-ramps for controlling the rate in which vehicles enter the highway. Again, in a stop-n-go system, the presence of a vehicle near a particular sensing zone triggers the indicator or timing of the indicator that directs the vehicle driver to enter the highway. Although the sensing of a vehicle will be used throughout this application as an example of the object being sensed, it is apparent that other objects, particularly of metallic-comprising material can be sensed by the object sensing device 50.

As shown in FIG. 3, the vehicle sensing device 50 includes an inductive loop 52 serving as a sensor for sensing the presence of a vehicle 74 in proximity to a sensing zone 76. The inductive loop 52 is coupled to a conventional oscillator 56 by way of a conventional isolation transformer 54. The oscillator 56, or more generally a signal generator, is coupled to a conforming circuit 58, which is, in turn, coupled to a microprocessor 60.

In operation, when a vehicle 74 approaches the sensing zone 76, the inductance L of the inductive loop 52 changes due to the metallic structure of the vehicle. In other words, as a metal object gets closer to the inductive loop 52, its inductance changes. Because the inductive loop 52 is coupled to the oscillator 56 by way of the isolation transformer 54, and specifically, it is coupled to the frequency-determining circuitry of the oscillator, the oscillator generates a sinusoidal signal 68 that cycles at a frequency dependent on the inductance L of the inductive loop. This inductance-dependent frequency can be expressed as follows: $f(L)$, where L represents the inductance of the inductive loop 52. Therefore, when there is an absence of a vehicle 74 in the sensing zone 76, the inductance L of the inductive loop 52 has a certain value that can be represented as $L_0$, which causes the oscillator 56 to generate a sinusoidal signal 68 having a frequency defined as $f_0(L_0)$. When there is a presence of a vehicle in the sensing zone 76, then the inductance of the inductive loop has changed from $L_0$ to another value that can be represented as $L_1$, which causes the oscillator 56 to generate a sinusoidal signal 68 having a frequency defined as $f_1(L_1)$.

The sinusoidal signal 68 is then applied to the conforming circuit 58 which converts the sinusoidal signal to a square-wave signal 70 and adjusts its level so that it is appropriate for receipt and recognition by the microprocessor 60. This can be performed by a conventional limiter and conventional signal leveling circuit. The microprocessor 60 detects the frequency of the square-wave signal 70, and specifically, determines whether the frequency of the signal 70 is either within an acceptable range around $f_0(L_0)$ indicating an absence of a vehicle 74 in the sensing zone 76, or within an acceptable range around $f_1(L_1)$ indicating a presence of the vehicle 74 in the sensing zone 76. If the microprocessor 60 determines that there is a presence of the vehicle 74 in the sensing zone 76 according to the frequency of the signal 70 it detects, then it can issue an appropriate instruction to a controlled unit or a vehicle driver stimulus device to perform its intended function. Such controlled unit or vehicle driver stimulus device can include, for example, automatic gate openers, traffic light controllers or stop-n-go systems.

Because of the desire for integrating, compacting and reducing interconnections of the object or vehicle sensing device 50 in order reduce cost and time; facilitate manufacturing, testing, maintenance and repair; and improve its reliability, it has been found that integrating the oscillator 56, conforming circuit 58 and microprocessor 60 with the inductive loop 52 in a single package results in the above-mentioned improvements. However, it has resulted in the object or vehicle sensing device 50 being exposed to the same environmental conditions that the inductive loop 52 is exposed to.

Often, but not necessarily, the inductive loop 52 is embedded in a pavement 72 forming the road surface in which vehicles trespass. This pavement 72 can be exposed to varying temperatures due to exposure to sunlight or shade, the ambient temperature or other sources of heat. Because of the above desire to integrate the other components of the object or vehicle sensing device 50, these components also are exposed to such varying temperatures. For the purpose of the application, the "environment temperature" is defined as the temperature for which the object or vehicle sensing device 50 is exposed to. As a result, the performance of these components are affected by changes in the environment temperature. Therefore, there is a need for temperature compensating the object or vehicle sensing device so that it can properly operate under varying environment temperatures.

In particular, one component of the object or vehicle sensing device 50 whose response is affected due to changes in the environment temperature is the oscillator 56. The oscillator 56 is affected in a way that the sinusoidal signal 68 it produces has a frequency that varies not only as a function of the inductance L of the inductive loop 52, but also as a function of the environment temperature which is herein represented as T. Accordingly, the sinusoidal signal 68, and likewise, the square-wave signal 70, will cycle at a frequency that is dependent on both the inductance L of the inductive loop 52 and the environment temperature T, and can be represented as $f(L,T)$. Again, if $L_0$ represents the inductance of the inductive loop 52 when there is an absence of an object or vehicle in the sensing zone 76, then the frequency of the signals 68 and 70 can be represented as $f_0(L_0,T)$. Likewise, if $L_1$ represents the inductance of the inductive loop 52 when there is a presence of an object or vehicle in the sensing zone 76, then the frequency of signals 68 and 70 can be represented as $f_1(L_1,T)$. Both frequencies $f_0(L_0,T)$ and $f_1(L_1,T)$ are temperature-uncompensated frequencies.

In a temperature uncompensated sensing device, a microprocessor receives the current frequency reading which can be designated $f_c(L_c,T)$ (which is temperature uncompensated) and determines whether it falls within an acceptable frequency range around $f_0(L_0)$ that represents a nominal value of the frequency when there is no object or vehicle in the sensing zone, or within an acceptable frequency range around $f_1(L_1)$ that represents a nominal frequency when there is an object or vehicle present in the sensing zone. If the current frequency reading $f_c(L_c,T)$ is within the acceptable range around $f_0(L_0)$, then it is an indication that there is absence of an object or vehicle in the sensing zone. If, on the other hand, the current frequency reading $f_c(L_c,T)$ is within the acceptable frequency range around $f_1(L_1)$, then it is an indication that there is an object or vehicle in the sensing zone.

The environment temperature problem arises from the fact that it is not known from the current reading of the frequency $f_c(L_c,T)$ whether a change is due to environmental temperature variations or due to an object or vehicle coming into the sensing zone. It is possible that a relative large environmental temperature change may cause the current frequency reading $f_c(L_c,T)$ to be within the acceptable range around $f_1(L_1)$ when there is no object or vehicle in the sensing zone. Thereby, giving a false indication that an object or vehicle is in the sensing zone.

Therefore, in order to compensate for environmental temperature changes, the object or vehicle sensing device 50 includes a switchable conductive path 64 comprising a pair of conductors 65 each having a first end connected to the respective ends of the inductive loop 52, preferably near the oscillator 56, and a second opposing end connected to a relay switch 66. The relay switch 66 is controlled by the microprocessor 60 by way of a driver 67 for selectively shorting the inductive loop 52, or more generally, selectively de-coupling or isolating the inductive loop 52 from the oscillator 56.

The temperature compensation works as follows. The microprocessor 60 periodically causes the relay switch 66 to short the inductive loop 52 so that its inductance L does not affect the frequency-determining circuit of the oscillator 56. Therefore, the oscillator 56 produces a sinusoidal signal 68 that cycles at a frequency that is not substantially dependent on the inductance L of the inductive loop 52, but dependent on the environment temperature T. This frequency may be defined herein as a reference frequency $f_R(T)$. By having the microprocessor 60 periodically monitor the reference frequency $f_R(T)$, and specifically, monitor the changes in the reference frequency which are due to changes in the environment temperature T, then the current frequency $f_c(L_c,T)$ can be compensated for changes in temperature. In other words, a temperature-compensated response can be arrived at that is indicative of whether an object or vehicle is in the sensing zone from the examination of the current frequency $f_c(L_c,T)$ and the reference frequency $f_R(T)$, or processing of their respective periodical signals. The concept behind the temperature compensation is that changes in the environment temperature T will similarly effect the current frequency $f_c(L_c,T)$ and the reference frequency $f_R(T)$, if these are measured at close time interval with respect to each other. In the preferred embodiment, 25 frequency readings per second are taken, altering between measurements of the current frequency $f_c(L_c,T)$ and the reference frequency $f_R(T)$.

The preferred method of arriving at the temperature-compensated response using the current and reference frequency readings $f_c(L_c,T)$ and $f_R(T)$ is by having the microprocessor take the difference between the changes in consecutive current frequency readings $\Delta f_c(L_c,T)$ and the changes in consecutive reference frequency readings $\Delta f_R(T)$, whereby a temperature-compensated frequency response $f_{TC}(L_c,T)=\Delta f_c(L_c,T)-\Delta f_R(T)$ is arrived. In this case, if the temperature-compensated reading $f_{TC}(L_c,T)$ is small or within a pre-defined range around zero Hz, then the microprocessor 60 can determine that the changes in the current frequency $\Delta f_c(L_c,T)$ was due to changes in the environment temperature T, and not due to an object or vehicle entering the sensing zone. Conversely, in this case, if the temperature-compensated response $f_{TC}(L_c,T)$ is relatively large or above a certain threshold level, then the microprocessor 60 can determine that the changes in the current frequency $\Delta f_c(L_c,T)$ was due to an object or vehicle entering the sensing zone.

As an example, if the reference frequency $f_R(T)$ has changed around 300 Hz between consecutive readings, and the current frequency $f_c(L_c,T)$ has also changed around 300 Hz within corresponding consecutive readings, then the microprocessor 60 determines that the temperature-compensated response $f_{TC}(L_c,T)$ is around 0 Hz or within an acceptable range around 0 Hz, that it knows that the change was due to environment temperature changes, rather than an object or vehicle coming within the sensing zone. If, on the other hand, the reference frequency $f_R(T)$ has changed around 300 Hz between consecutive readings, and the current frequency $f_c(L_c,T)$ has changed around 1300 Hz within corresponding consecutive readings, then the microprocessor 60 determines that the temperature-compensated response $f_{TC}(L_c,T)$ is around 1000 Hz or within an acceptable range around 1000 Hz, that it knows that the change was due to an object or vehicle coming within the sensing zone, and not due to an environment temperature change.

It shall be understood that there are many other ways of arriving at a temperature-compensated response from examination of the current frequency $f_c(L_c,T)$ and the reference frequency $f_R(T)$. For example, another method of producing a temperature-compensated response is to initially determine acceptable frequency ranges at a particular environment temperature $T_0$, around $f_0(L_0,T_0)$ (object or vehicle not in sensing zone) and around $f_1(L_1,T_0)$ (object or vehicle not in sensing zone). Then, take the difference between the current reference frequency reading $f_R(T_c)$ and the reference frequency reading $f_R(T_0)$, i.e.:

$$\Delta f_R(T_c-T_0)=f_R(T_c)-f_R(T_0)$$

Then, a temperature-compensated response $f_{TC}(L_c,T)$ can be arrived by taking the difference between the current frequency $f_c(L_c,T)$ and the change in the reference frequency $\Delta f_R(T_c-T_0)$, i.e.:

$$f_{TC}(L_c,T)=f_c(L_c,T)-\Delta f_R(T_c-T_0)$$

This temperature-compensated response $f_{TC}(L_c,T)$ can be compared to the acceptable ranges around $f_0(L_0,T_0)$ (object or vehicle not in sensing zone) and $f_1(L_1,T_0)$ (object or vehicle not in sensing zone) to see if it lies within such range to determine whether an object or vehicle is in the sensing zone.

Yet another method at arriving at a temperature-compensated response indicative of whether an object or vehicle in the sensing zone is similar to the one described in the previous paragraph, but with the difference that the acceptable ranges around $f_0(L_0,T_0)$ (object or vehicle not in sensing zone) and $f_1(L_1,T_0)$ (object or vehicle not in sensing zone) are changed by the change in reference $\Delta f_R(T_c-T_0)$ from its $T_0$ environment temperature response. That is, the temperature-compensated nominal frequency values around the acceptable frequency ranges are as follows:

$$f_{TC0}(L_0,T_c-T_0)=f_0(L_0,T_0)-\Delta f_R(T_c-T_0) \text{ (object or vehicle not in sensing zone)}$$

$$f_{TC1}(L_1,T_c-T_0)=f_1(L_1,T_0)-\Delta f_R(T_c-T_0) \text{ (object or vehicle is in sensing zone)}$$

In this case, the microprocessor 60 determines whether the current frequency $f_c(L_c,T)$ reading is within an acceptable range around $f_{TC0}(L_0,T_c-T_0)$ (object or vehicle not in sensing zone) and $f_{TC1}(L_1,T_c-T_0)$ (object or vehicle is in sensing zone) to determine whether an object or vehicle is in the sensing zone.

It shall be understood, that many other ways of obtaining a temperature-compensated response from the current frequency reading $f_c(L_c,T)$ and the reference frequency $f_R(T)$ can be achieved. The concept is using the reference frequency $f_R(T)$ to compensate the current frequency reading $f_c(L_c,T)$ to end up at a temperature-compensated response for which to base the determination of whether there is an object or vehicle in the sensing zone. Therefore, the scope of the invention is not dependent on how the temperature-compensated response is arrived at from the current frequency reading $f_c(L_c,T)$ and the reference frequency $f_R(T)$.

The advantage of the object or vehicle sensing device of the invention is that there is no need to include an additional reference oscillator to compensate for environment temperature variations, as the prior art discloses. This translates into a cost and time saving in parts, inventory, manufacturing, testing, repairing and maintaining. It further results in a more reliable device since less components, translates to a statistically more reliable product.

Although the conductive path 64 is the preferred method of de-coupling or isolating the inductive loop 52 from the oscillator 56, it shall be understood that other manners of de-coupling the inductive loop from the oscillator can be used. For example, the path between the inductive loop 52 and the oscillator 56 may be opened, rather than shorted, so that the inductive loop is de-coupled or isolated from the oscillator. Also, it shall be understood that a relay switch 66 need not be the only way to selectively short the inductive loop 52, or de-couple it from the oscillator. The switch could be a solid state switch or the like, or any other type of switch that can short the inductive loop so that it is de-coupled from the oscillator 56.

In the more general sense, the object or vehicle sensor need not be an inductive loop 52, although it is preferred, the sensor just has to exhibit a characteristic that is responsive to the distance the object or vehicle is from the sensor. This could be an already known sensor or one that may be developed in the future. The oscillator need not be an oscillator, but could be, more generally, a signal generator that produces a signal having a frequency dependent on the characteristic of the sensor. Also a microprocessor 60 need not be used, but other circuits that can detect the frequency of the signal generated by the signal generator can be used, and that can produce a temperature-compensated response from the temperature-uncompensated frequency $f_c(L_c,T)$ and the reference frequency $f_R(T)$.

Referring now to FIG. 4, a gate operating system 100 as per another aspect of the invention is shown. The gate operating system 100 is useful for controlling a gate 102 so that the egress and ingress of vehicles from and to certain areas are provided. Such areas typically include parking lots, gated housing or apartments, or restricted or highly sensitive areas, such as those used in the military or industrial parks. The gate 102 shown is of the type that moves horizontally from a closed position to an open position and vice-versa, by way of a guiding track and rollers. The specific designs or types of the gates used in the gate operating system 100 are not critical to the invention, and can include, for example, gates that rotate between open and closed positions about a vertically-oriented hinge, or gates that rotate between open and closed positions about a horizontally-oriented hinge, commonly used in parking lots.

The gate operating system 100 further includes a drive train 112 mechanically coupled to the gate 102 for moving the gate between open and closed positions. The drive train 112 can be, but not necessarily, a speed reduction type of drive train. A conventional drive motor 110 is coupled to the drive train 112 for causing the drive train to move the gate 102 between its open and closed positions. A motor control circuit 108 is provided in the gate operating system 100 for controlling the drive motor 110 so that the forward and reverse operations of the motor is provided, including the stopping and shutting off (parking) of the motor.

The motor control 108 may also include inputs for sensing when the gate has reached its open and closed positions. As it is conventionally known, the open and closed positions can be determined using switches (not shown), barriers or stops, such as those indicated by reference number 104 and 106 in FIG. 4, or other types of limit or position sensing devices. Once detecting that the open or closed position has been reached, the motor control 108 couples a signal to the drive motor 110 instructing it to stop. The motor control 108 may further include an input from an obstruction sensor for sensing if some object has obstructed the movement of the gate 102. If the motor control 108 receives an obstruction indication from its input, then it causes the drive motor 110 to either stop, cause the gate to move to its open or closed position, or move slightly away from the obstruction, as it is so desired. An obstruction can also be sensed by sensing the current of the drive motor 110, where an obstruction is indicated when the motor current increases above a certain threshold level.

The gate operating system 100 further includes a vehicle sensing device 50 of the type previously described. The vehicle sensing device 50 is used in the gate operating system for sensing the presence of a vehicle within a sensing zone, that is preferably near or on both sides of the gate 102, and opening such gate when the presence of such vehicle is initially detected, and also to keep the gate open if the vehicle remains in the sensing zone. The vehicle sensing device 50 will also be used to detect when a vehicle has left a sensing zone, so that the gate operating system 100 closes the gate immediate or after a pre-determined time interval after the vehicle has departed the sensing zone.

In operation, when a vehicle approaches and penetrates the sensing zone, the vehicle sensing device 50 will produce a temperature-compensated response that indicates that a vehicle is in the sensing zone. This response is then coupled or transmitted to the motor control 108. When the motor control 108 receives the temperature-compensated response, and if it indicates that a vehicle is in the sensing zone, it will issue an instruction to the drive motor 110 to operate in a manner that the gate moves from its closed position to its open position. Once this occurs, the vehicle is allowed to leave the sensing zone, pass through the gate, and ingress or egress to and from the gated area. The motor control 108 will not issue an instruction to the drive motor 110 to operate in a manner that the gate 102 closes, as long as the temperature-compensated response indicates that the vehicle is still in the sensing zone.

When the vehicle leaves the sensing zone, the vehicle sensing device 50 will produce a temperature-compensated response that indicates that there is an absence of a vehicle in the sensing zone. This response is coupled or transmitted to the motor control 108. Once the motor control 108 senses that the temperature-compensated response has changed from indicating the presence of a vehicle in the sensing zone to indicating an absence of the vehicle in the sensing zone, the motor control 108 issues an instruction to the drive motor 110 to operate in a manner that the gate 102 moves from its open position to its closed position. Alternatively, the motor control 108 may wait a pre-determined time interval before instructing the drive motor 110 so that sufficient time is given to the vehicle to move away from the gate area. The time interval operation of the motor control 108 can be performed using a conventional timing circuit or the like.

The gate operating system 100 may be packaged as a single integrated unit, including the vehicle sensing device 50, motor control 108, drive motor 110 and the drive train 112. Or they may be packaged in separate units, such as the vehicle sensing device being integrated into a single unit embedded, for example, in the pavement 72 forming the surface of the road where the vehicle trespass; and the motor control 108, drive motor 110 and drive train 112 being integrated into another single unit situated, for example, near the gate 102, such as where the drive train is situated with respect to the gate in FIG. 4. Of course, transmission of the temperature-compensated response to the motor control unit 108 is required, and this can be performed using cables or the like, or by radio waves. In any event, the manner of packaging the gate operating system 100 is not critical to the invention, and many other manners of packaging the unit come within the scope of the invention.

Although the present invention has been described in detail with regarding the exemplary embodiments and drawings thereof, it should be apparent to those skilled in the art that various adaptations and modifications of the present invention may be accomplished without departing from the spirit and scope of the invention. Accordingly, the invention is not limited to the precise embodiment shown in the drawings and described in detail hereinabove.

It is claimed:

1. A device for sensing an object in proximity to a sensing zone, wherein the device is exposed to an environment temperature, comprising:

a sensor having a characteristic responsive to the proximity of the object is to the sensor;

a signal generator coupled to the sensor for producing a first periodical signal cycling at a first frequency dependent on the sensor characteristic and the environment temperature;

a de-coupling mechanism for de-coupling the sensor from the signal generator so that the signal generator produces a second periodical signal cycling at a second frequency dependent on the environment temperature, but not substantially dependent on the characteristic of the sensor; and a device for producing a temperature-compensated response indicative of whether the object is in the sensing zone from the first and second frequencies.

2. The object sensing device of claim 1, wherein the sensor includes an inductive loop and the sensor characteristic is the inductance of the inductive loop.

3. The object sensing device of claim 2, wherein the de-coupling mechanism is a switchable conductive path for selectively shorting the inductive loop.

4. The object sensing device of claim 3, wherein the signal generator is an oscillator.

5. The object sensing device of claim 4, further including an isolating transformer coupling the inductive loop with the oscillator.

6. The object sensing device of claim 3, wherein the switchable conductive path includes a pair of conductors coupled to the inductive loop and coupled to a relay switch.

7. The object sensing device of claim 6, wherein a microprocessor controls the relay switch so that the conductive path selectively shorts the inductive loop.

8. The object sensing device of claim 1, wherein a microprocessor performs the frequency detection of the first and second frequencies and determines the temperature-compensated response.

9. The object sensing device of claim 8, further including a conforming circuitry for converting the first and second periodical signals to a substantially square-wave waveform for input to the microprocessor.

10. A method for temperature-compensating the sensing of an object in a sensing zone in the presence of an environment temperature, comprising:

producing a sensing response indicative of the distance of the object is from the sensing zone;

generating a first periodical signal cycling at a first frequency that is dependent on the environment temperature and the response;

isolating the sensing response from the generating of the first periodical signal step so that a second periodic signal is generated that cycles at a second frequency dependent on the environment temperature, but not dependent on the sensing response; and producing a temperature-compensated response indicative of whether the object is in the sensing zone from the first and second periodic signals.

11. The method of claim 10, wherein the step of producing a sensing response includes the step of producing a change in inductance of an inductive loop as the object moves closer to the inductive loop.

12. The method of claim 11, wherein the step of generating the first periodical signal includes the step of coupling the inductive loop to an oscillator frequency-determining circuit.

13. The method of claim 12, wherein the step of isolating the sensing response includes the step of shorting the inductive loop in a manner that the oscillator frequency-determining circuit is substantially unaffected by the inductance of the inductive loop.

14. The method of claim 13, wherein the step of producing the temperature-compensated response includes determining the difference between consecutive changes of the first and second frequencies.

15. A device for indicating to a vehicle driver to perform a certain driving action, the device being responsive to the presence of a vehicle in a sensing zone, wherein the device is exposed to an environment temperature, comprising:

a sensor having a characteristic responsive to the distance of the vehicle is from the sensor;

a signal generator coupled to the sensor for producing a first periodical signal cycling at a temperature-uncompensated frequency dependent on the sensor characteristic and the environment temperature;

a de-coupling mechanism for de-coupling the sensor from the signal generator so that the signal generator produces a second periodical signal cycling at a reference frequency dependent on the environment temperature, but not substantially dependent on the characteristic of the sensor;

a device for producing a temperature-compensated response from the temperature-uncompensated frequency and the reference frequency, wherein the temperature-compensated response is indicative of whether the vehicle is in the sensing zone; and driver stimulus device for indicating to the vehicle driver to perform the action when the vehicle has been detected in the sensing zone.

16. The device of claim 15, wherein the sensor includes an inductive loop and the sensor characteristic is the inductance of the inductive loop.

17. The device of claim 16, wherein the de-coupling mechanism is a switchable conductive path for selectively shorting the inductive loop.

18. The device of claim 17, wherein the signal generator is an oscillator.

19. The device of claim 18, further including an isolating transformer coupling the inductive loop with the oscillator.

20. The device of claim 17, wherein the switchable conductive path includes a pair of conductors coupled to the inductive loop and coupled to a relay switch.

21. The device of claim 20, wherein a microprocessor controls the relay switch so that the conductive path is selectively controlled to short the inductive loop.

22. The device of claim 15, wherein a microprocessor performs the frequency detection of the temperature-uncompensated and reference frequencies, and determines the temperature-compensated response.

23. The device of claim 22, further including a conforming circuitry for converting the first and second periodical signals to a substantially square-wave signal for input to the microprocessor.

24. The device of claim 15, wherein the driver stimulus device is an automatic gate opener, a traffic light signal or a stop-n-go signal.

25. A gate operating system for controlling a gate in response to a vehicle being detected in a sensing zone, wherein at least a portion of the gate operating system is exposed to an environment temperature, comprising:

a drive train for moving the gate between open and closed positions;

a drive motor coupled to the drive train for causing the drive train to move the gate between the open and closed positions;

a vehicle sensing device, comprising:

a sensor having a characteristic responsive to the proximity of the vehicle is to the sensor;

a signal generator coupled to the sensor for producing a first periodical signal cycling at a first frequency dependent on the sensor characteristic and the environment temperature;

a de-coupling mechanism for de-coupling the sensor from the signal generator so that the signal generator produces a second periodical signal cycling at a second frequency dependent on the environment temperature, but not substantially dependent on the characteristic of the sensor; and a device for producing a temperature-compensated response indicative of whether the vehicle is in the sensing zone from the first and second periodical signals; and a motor control circuit coupled to the vehicle sending device for receiving therefrom the temperature-compensated response, and coupled to the motor for controlling the drive motor to cause the drive train to move the gate to the open position when the temperature-compensated response indicates the presence of the vehicle in the sensing zone.

26. The gate operating system of claim 25, wherein the motor control circuit includes a timing device for controlling the drive motor to cause the drive train to move the gate from the open position to the closed position after a predetermined time interval.

27. The gate operating system of claim 25, wherein the sensor includes an inductive loop and the sensor characteristic is the inductance of the inductive loop.

28. The gate operating system of claim 27, wherein the de-coupling mechanism is a switchable conductive path for selectively shorting the inductive loop.

29. The gate operating system of claim 28, wherein the switchable conductive path includes a pair of conductors coupled to the inductive loop and coupled to a relay switch.

30. The gate operating system of claim 29, wherein a microprocessor controls the relay switch so that the conductive path selectively shorts the inductive loop.

31. The gate operating system of claim 25, wherein the signal generator is an oscillator.

32. The gate operating system of claim 31, further including an isolating transformer coupling the inductive loop with the oscillator.

33. The gate operating system of claim 25, wherein a microprocessor performs the frequency detection of the first and second frequencies and determines the temperature-compensated response.

34. The gate operating system of claim 33, further including a conforming circuitry for converting the first and second periodical signals to a substantially square-wave waveform for input to the microprocessor.

* * * * *